US009256174B2

(12) United States Patent
Yamamoto

(10) Patent No.: US 9,256,174 B2
(45) Date of Patent: Feb. 9, 2016

(54) ENDLESS BELT, IMAGE HEATING APPARATUS AND MOUNTING METHOD

(71) Applicant: CANON KABUSHIKI KAISHA, Tokyo (JP)

(72) Inventor: Naoyuki Yamamoto, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/635,217

(22) Filed: Mar. 2, 2015

(65) Prior Publication Data

US 2015/0248090 A1 Sep. 3, 2015

(30) Foreign Application Priority Data

Mar. 3, 2014 (JP) ..... 2014-040403

(51) Int. Cl.
*G03G 15/16* (2006.01)
*G03G 15/20* (2006.01)
*G03G 21/16* (2006.01)

(52) U.S. Cl.
CPC ..... *G03G 15/2053* (2013.01); *G03G 21/1685* (2013.01)

(58) Field of Classification Search
CPC ..... G03G 15/2053; G03G 21/1685
USPC ..... 399/107, 110, 122, 329
See application file for complete search history.

(56) References Cited

U.S. PATENT DOCUMENTS 5,568,240 A 10/1996 Ohtsuka
5,778,293 A 7/1998 Ohtsuka
6,347,205 B1 * 2/2002 Morganti et al. ..... 399/122
7,196,296 B2 3/2007 Yamamoto
7,205,514 B2 4/2007 Suzuki et al.
7,238,924 B2 7/2007 Kondo et al.
7,268,326 B2 9/2007 Yamamoto et al.
7,268,327 B2 9/2007 Yamamoto et al.
7,283,780 B2 10/2007 Uchida et al.
8,099,008 B2 1/2012 Nakase et al.
8,135,323 B2 * 3/2012 Suzuki et al. ..... 399/329
8,358,949 B2 1/2013 Nakase et al.
8,606,160 B2 12/2013 Nakase et al.
8,615,175 B2 12/2013 Imada et al.
RE45,015 E 7/2014 Uchida et al.
8,843,042 B2 9/2014 Nawa et al.
8,843,046 B2 9/2014 Nawa et al.
8,918,044 B2 12/2014 Takematsu et al.

(Continued)

FOREIGN PATENT DOCUMENTS

JP H07-114276 A 5/1995
JP 2006-293225 A 10/2006
JP 2011-191520 A 9/2011

OTHER PUBLICATIONS

U.S. Appl. No. 14/525,283, filed Oct. 28, 2014.

*Primary Examiner* — Hoang Ngo
(74) *Attorney, Agent, or Firm* — Fitzpatrick, Cella, Harper & Scinto

(57) ABSTRACT

An endless belt detachably mountable to an image heating apparatus includes: a lubricant applied along a longitudinal direction of the endless belt onto a part of an inner surface of the endless belt with respect to a circumferential direction; and an indicating portion configured to indicate a mounting phase of the endless belt to an operator. The indicating potion is provided on an outer surface of the endless belt so as to have a positional relationship with an applied region of the lubricant with respect to the circumferential direction.

11 Claims, 12 Drawing Sheets

(56) References Cited

U.S. PATENT DOCUMENTS

| | | | |
|---|---|---|---|
| 2006/0233575 | A1 | 10/2006 | Uchida et al. |
| 2011/0091230 | A1 | 4/2011 | Yamamoto |
| 2011/0222875 | A1 | 9/2011 | Imada et al. |
| 2014/0029992 | A1 | 1/2014 | Yamamoto |
| 2014/0286663 | A1 | 9/2014 | Yamamoto |

* cited by examiner

ENDLESS BELT, IMAGE HEATING APPARATUS AND MOUNTING METHOD

FIELD OF THE INVENTION AND RELATED ART

The present invention relates to an image heating apparatus for heating a toner image on a sheet, an endless belt for use with the image heating apparatus, and a mounting method.

In recent years, in an image forming apparatus of an electrophotographic type, such as a printer, a copying machine, a facsimile machine or a multi-function machine of these machines, there have been market demands for downsizing, a cost reduction, and energy saving of the image forming apparatus, and particularly these demands are noticeable in office (-purpose) image forming apparatuses. In order to meet these demands, a fixing device having small thermal capacity has been proposed and put into practical use. As a specific means for lowering the thermal capacity of the fixing device, there is a fixing device of a belt heating type using a fixing belt (endless belt), and the following constitution has been proposed.

The fixing belt is provided between a ceramic heater (urging member) and a pressing roller, and the toner image is fixed on the sheet by applying heat from the ceramic heater to the toner image via the fixing belt (Japanese Laid-Open Patent Application (JP-A) 2006-293225). Further, a belt-heating type in which a halogen heater is provided inside the fixing belt has been proposed (JP-A 2011-191520). Further, a belt-heating type has been proposed in which the fixing belt is provided so as to be sandwiched between an urging pad (urging member) and a pressing roller, and an electroconductive layer of the fixing belt is heated through electromagnetic induction heating (JP-A Hei 7-114276).

These belt-heating types have an advantage that the waiting time from power-on of the image forming apparatus until the image forming apparatus is in a state in which image formation can be started is capable of being shortened (quick start property) since the thermal capacity of the fixing belt is small.

In the above-described fixing device of the belt-heating type, it has been known that for the purpose of reducing the sliding resistance between the fixing belt and the urging member, a lubricant, such as grease, is applied between an inner surface of the belt and the urging member. In the case where an application amount of the grease is small and the grease is not applied uniformly, there is a liability that the traveling (running) stability of the fixing belt is impaired and that the sliding resistance between the fixing belt and the urging member becomes high.

On the other hand, in the case where the application amount of the grease is high, there is a liability that the grease comes out of end portions of the fixing belt and adhesives to the surfaces of the fixing belt and the pressing roller to cause an image defect.

Accordingly, in order to maintain the sliding property between the fixing belt and the urging member in a good state, it is preferable that the application amount and the applied state of the grease are controlled at certain reference levels. Particularly, in the case where the fixing belt is exchanged for maintenance, the grease is required to be applied uniformly in a proper amount onto the surface of the urging member, but depending on the degree of skill of an operator, there is also the possibility that the application of the grease becomes nonuniform.

SUMMARY OF THE INVENTION

According to an aspect of the present invention, there is provided an endless belt detachably mountable to an image heating apparatus, comprising: a lubricant applied along a longitudinal direction of the endless belt onto a part of an inner surface of the endless belt with respect to a circumferential direction; and an indicating portion configured to indicate a mounting phase of the endless belt to an operator. The indicating potion is provided on an outer surface of the endless belt so as to have a positional relationship with an applied region of the lubricant with respect to the circumferential direction.

According to another aspect of the present invention, there is provided an image heating apparatus comprising: an endless belt configured to heat a toner image on a sheet in a nip; a rotatable driving member configured to form the nip in cooperation with the endless belt and configured to drive the endless belt; an urging member, provided and extended along a longitudinal direction of the endless belt, configured to urge the endless belt toward the rotatable driving member; a limiting member configured to limit movement of the endless belt in the longitudinal direction by abutment against an end portion of the endless belt with respect to the longitudinal direction; a first mark portion provided on the limiting member; a lubricant applied onto a part of an inner surface of the endless belt with respect to a circumferential direction along a longitudinal direction of the endless belt; and a second mark portion configured to be positionally aligned with the first mark portion of the limiting member when the endless belt is fitted around the urging member. The indicating potion is provided on an outer surface of the endless belt so as to have a positional relationship with an applied region of the lubricant with respect to the circumferential direction.

According to a further aspect of the present invention, there is provided a mounting method of mounting an endless belt in an image heating apparatus, comprising: a step of preparing the endless belt which has an inner surface onto a part of which, with respect to a circumferential direction, a lubricant is applied along a longitudinal direction and which has an outer surface on which a first mark portion is provided so as to have a predetermined positional relationship with an applied region of the lubricant with respect to the circumferential direction; a step of aligning a position of the first mark portion of the endless belt with a position of a second mark portion provided in the image heating apparatus; and a step of mounting the endless belt in a state in which the positions of the first mark portion and the second mark portion are aligned with each other.

These and other objects, features and advantages of the present invention will become more apparent upon a consideration of the following description of the preferred embodiments of the present invention taken in conjunction with the accompanying drawings.

DESCRIPTION OF THE EMBODIMENTS

First Embodiment

Embodiments of the present invention will be described with reference to the drawings. In the following embodiments, a constitution in which an image heating apparatus is used as a fixing device for fixing an unfixed toner image on a sheet (recording material) will be described, but the present invention can also be carried out as a heat treatment device for adjusting an image surface property by heating the recording material on which a fixed image or a partly fixed image is carried. Dimensions, materials and shapes of constituent elements and their relative arrangements and the like described in the following embodiments should be changed appropriately depending on structures and various conditions of apparatuses (devices) to which the present invention is applied, and the present invention is not intended to be limited to the following embodiments. Incidentally, a belt mounting method of the present invention will be described in processing steps of a fixing device 6.

Figure 1:
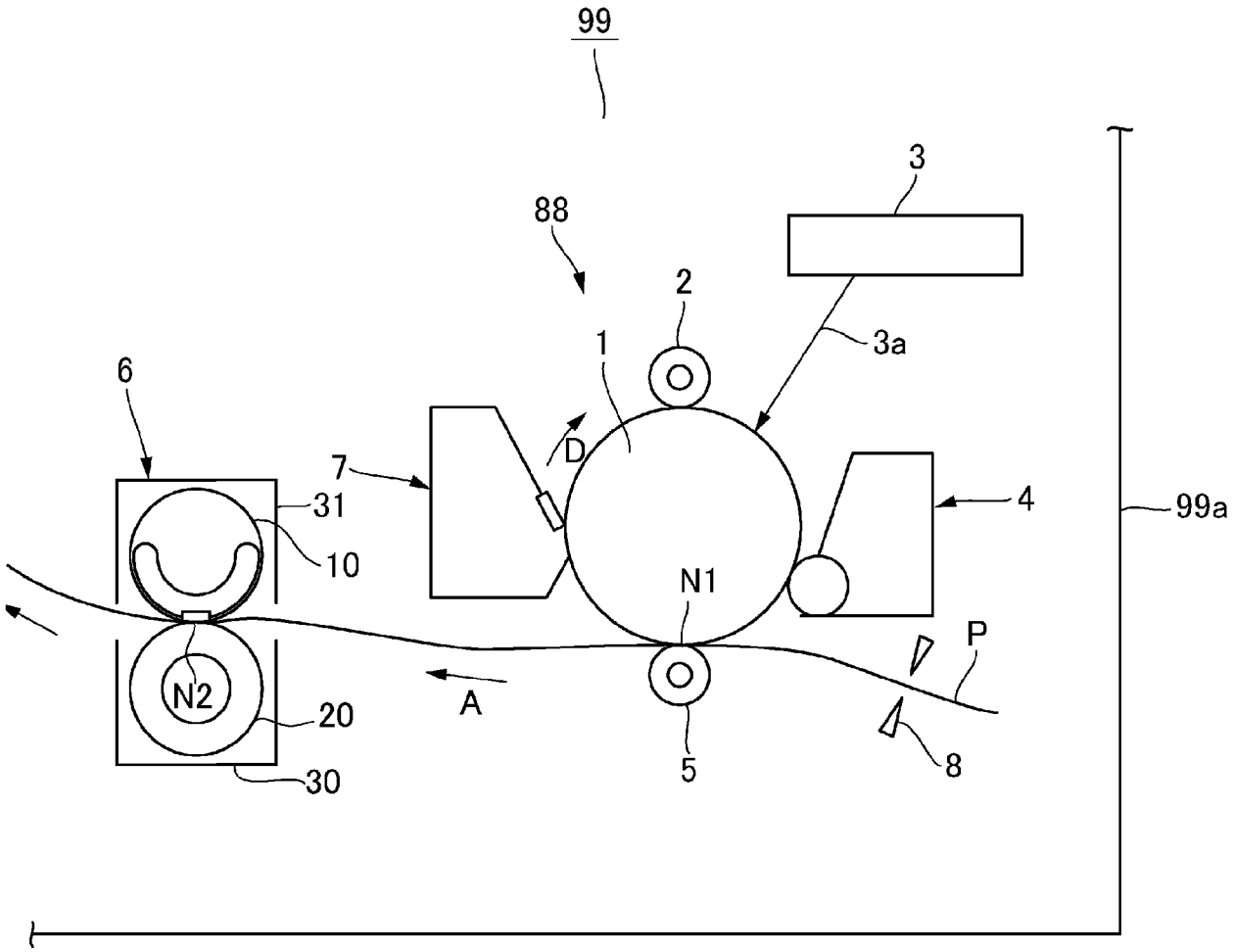
FIG. 1 is a schematic illustration of an image forming apparatus in a First Embodiment.

First, a color electrophotographic laser beam printer (image forming apparatus) including a fixing device to which the present invention is applicable will be described with reference to FIG. 1. FIG. 1 schematically shows the color electrophotographic laser beam printer in a state of a cross section along a feeding direction of the sheet. In the following embodiments, the color electrophotographic laser beam printer is simply referred to as a printer.

[Printer]

As shown in FIG. 1, a printer 99 as the image forming apparatus includes a printer main assembly (image forming apparatus main assembly) 99*a* in which an image forming portion 88 is provided. The image forming portion 88 includes a rotatable photosensitive drum 1 and members, consisting of a charging roller 2, a laser scanner 3, a developing device 4, a transfer roller 5 and a cleaning device 7, which are provided in the listed order along a rotational direction (arrow D direction) of the photosensitive drum 1. Further, the fixing device 6 as an image heating apparatus is provided downstream of the image forming portion 88 with respect to a sheet feeding direction (arrow A direction).

The fixing device 6 is a device using a fixing belt which is a cylindrical (endless) heating belt and employs a belt-heating type and a pressing-member-driving type.

The photosensitive drum 1 is constituted by forming, on a cylindrical electroconductive substrate of aluminum or nickel, a layer of photosensitive material such as an organic photoconductor (OPC), amorphous Se or amorphous Si. The photosensitive drum 1 is rotationally driven in an arrow D direction (clockwise direction) shown in FIG. 1.

At the image forming portion 88, a surface of the photosensitive drum 1 is electrically charged uniformly by a charging roller 2 to a predetermined potential and a predetermined polarity in advance. Thereafter, an electrostatic latent image is formed by the laser scanner 3, and then the electrostatic latent image is visualized (developed) as a toner image by the developing device 4. That is, the uniformly charged surface of the photosensitive drum 1 is subjected to scanning exposure to a laser beam 3*a* ON/OFF-controlled depending on image information by the laser scanner 3, so that an electrostatic latent image is formed.

This electrostatic latent image is developed and visualized as the toner image by the developing device 4. As a developing method, a jumping-developing method, a two-component developing method, a FEED developing method or the like is used, and in many cases, image exposure and reverse development are used in combination.

The toner image formed on the photosensitive drum 1 and then visualized from the latent image is transferred from the photosensitive drum 1 onto a sheet P fed at a predetermined timing by the transfer roller 5. That is, the sheet P is fed one by one from an unshown cassette or the like provided inside the printer main assembly 99*a*, and then is sent into a transfer nip between the photosensitive drum 1 and the transfer roller 5 by being timed to the toner image on the photosensitive drum 1 (in synchronism with the toner image).

Here, a leading end of the sheet P is detected by a sheet detecting sensor 8 so that an image forming position of the toner image on the photosensitive drum 1 and a writing start position of the leading end of the sheet P coincide with each other, thus adjusting the timing of these positions. The sheet P fed at predetermined timing is nipped and fed between the photosensitive drum 1 and the transfer roller 5, and then the toner image is transferred from the photosensitive drum 1 onto a sheet surface. After the transfer, the surface of the photosensitive drum 1 after separation of the sheet P is cleaned by removing a transfer residual toner remaining on the photosensitive drum surface by the cleaning device 7, and then the photosensitive drum surface is repetitively subjected to image formation.

Thereafter, the sheet P is separated from the surface of the photosensitive drum 1 and then is sent into a fixing nip N2 of the fixing device 6, in which the toner image is fixed on the sheet P by being heated and pressed in the fixing nip N2. The fixing device 6 includes a fixing belt (image heating belt) 10 as a heating belt and a pressing roller 20 as an opposing member. The fixing belt 10 as the heating belt heats the toner image (image) on the sheet P in the fixing nip (nip) N2. The pressing roller 20 as the opposing member is provided oppositely to the fixing belt 10 so as to form the fixing nip N2 between itself and the fixing belt 10.

The fixing belt 10 and the pressing roller 20 in the fixing device 6 are accommodated in a device casing 30 as a device body having left and right side plates 31. Incidentally, examples of the sheet (recording material) P may include plain paper, a resin-mate sheet material as an alternative to the plain paper, thick paper, a sheet for an overhead projector, and so on.

[Fixing Device]

Figure 2:
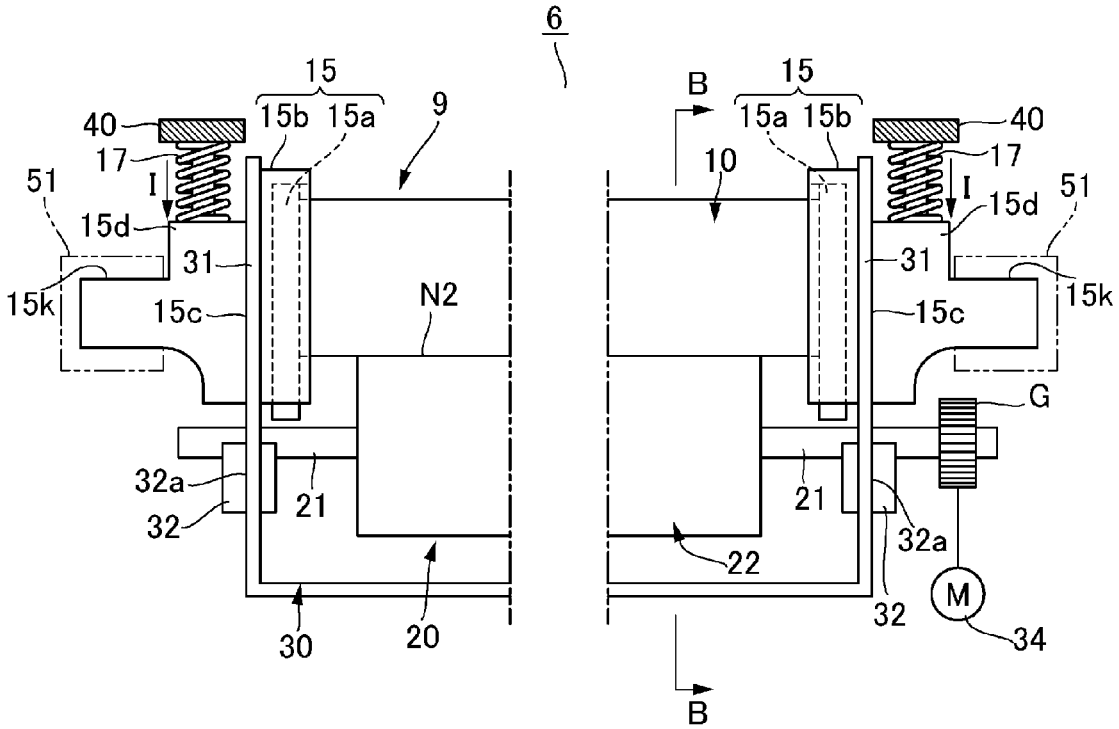
FIG. 2 is a front view of a fixing device from which a halfway portion is omitted in the First Embodiment.
Figure 3:
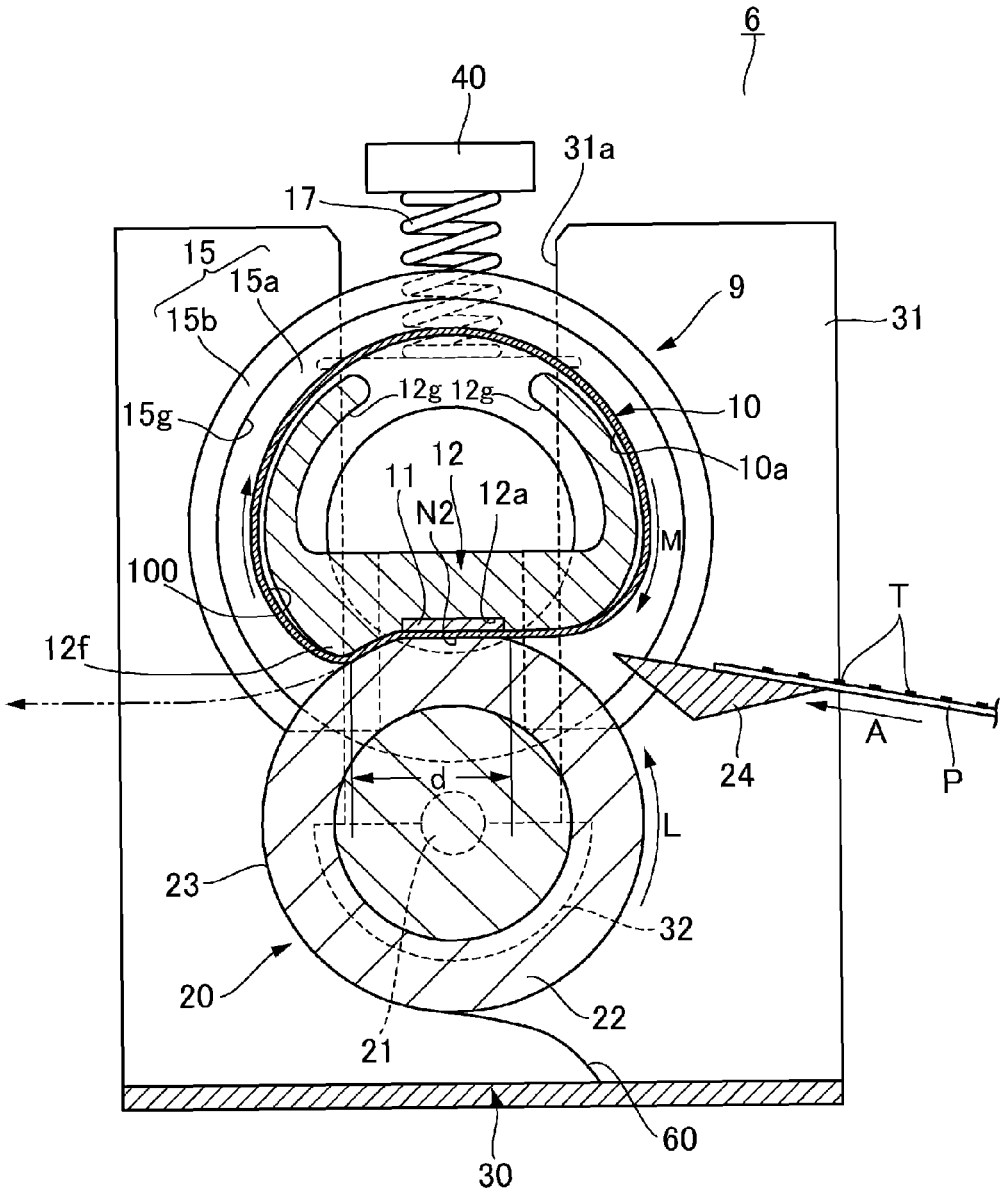
FIG. 3 is a sectional view of the fixing device taken along B-B line in FIG. 2 as seen in an arrow direction of the B-B line.
Figure 4:
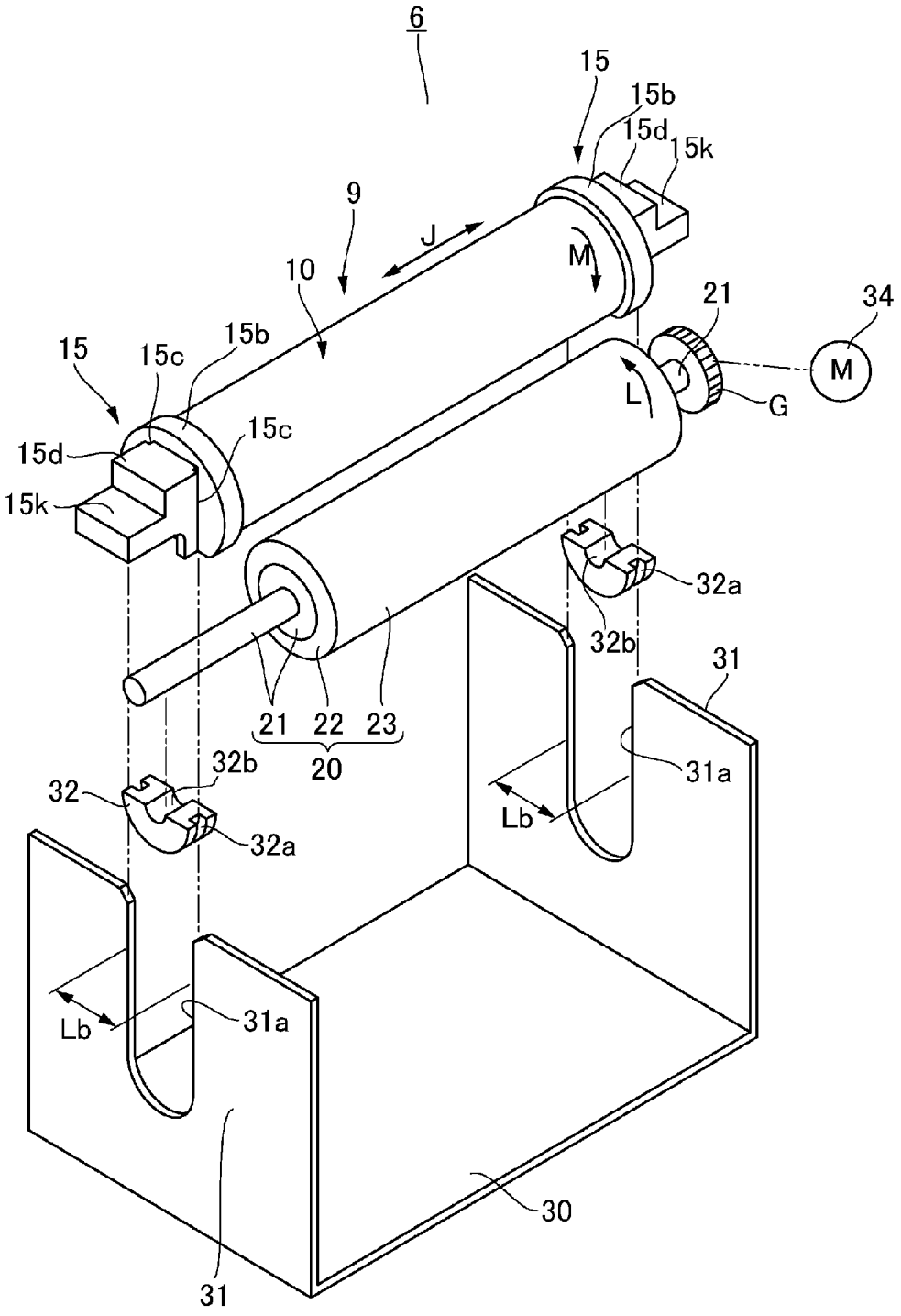
FIG. 4 is an exploded perspective view showing an exploded state of the fixing device.

The structure of the fixing device 6 in this embodiment will be described with reference to FIGS. 2 to 4. FIG. 2 is a schematic front view of the fixing device 6 from which a halfway portion is omitted. FIG. 3 is a sectional view of the fixing device 6 taken along B-B line in FIG. 2. FIG. 4 is an exploded perspective view showing an exploded state of the fixing device 6.

In the following description, a widthwise (longitudinal) direction of the fixing device 6 or members constituting the fixing device 6 is a direction parallel to a width direction (arrow J direction in FIG. 4) perpendicular to the sheet feeding direction (arrow A direction in FIG. 3) in a sheet feeding path plane. Further, with respect to the fixing device 6, a front surface (side) is a surface (side) as seen from a sheet entrance side, and a rear surface (side) is an opposite surface (side) (sheet exit side) from the front surface (side). Left and right mean left (left side in FIG. 2, front side in FIG. 3 and left side in FIG. 4) and right (right side in FIG. 2, rear side in FIG. 3 and right side in FIG. 4). An upstream side and a downstream side are determined with respect to the sheet feeding direction (arrow A direction).

As shown in FIGS. 2 to 4, the device casing 30 of the fixing device 6 includes the left and right side plates 31 each bent and erected from the bottom thereof. By the device casing 30, a heating unit (fixing member) 9 including the fixing belt 10 as the heating belt (endless belt) and the pressing roller (elastic pressing roller) 20 as an opposing member (rotatable driving member) are supported. The pressing roller 20 is disposed oppositely to the fixing belt 10 so as to form the fixing nip (nip) N2 between itself and the fixing belt 10. The fixing belt 10 heats the toner image on the sheet P in the fixing nip N2. The heating unit 9 and the pressing roller 20 are held between the left and right side plates 31 so that axial directions thereof are vertically parallel to each other, and the fixing nip N2 is formed by press-contact between the heating unit 9 and the pressing roller 20.

Each of the left and right side plates 31 is provided with a vertically elongated engaging groove 31*a* which is open in an upper side and which has a width Lb. The engaging grooves 31*a* of the left and right side plates 31 have the same shape and are disposed in a bilaterally symmetrical manner. Left and right bearing members (shaft-supporting members) 32 formed of a heat-resistant resin material such as PEEK, PPS or a liquid crystal polymer are mounted on the bottoms of the engaging grooves 31*a*, respectively, in a state in which an engaging portion 32*a* of each of the bearing members 32 is engaged with a bottom portion of the associated engaging groove 31*a*. Each of the bearing members 32 is formed in a substantially semicircular shape, and the engaging portion 32*a* thereof is formed so as to extend along an outer peripheral portion. In place of the bearing members 32, it is also possible to use bearings.

As shown in FIGS. 2 to 4, the pressing roller 20 includes a metal core 21 formed so as to extend between the left and right bearing members 32 and an elastic layer 22 formed on an outer peripheral surface of the metal core 21 with a heat-resistant rubber such as silicone rubber or a fluorine-containing rubber or with a foam(ed) silicone rubber.

On the elastic layer 22, a parting layer 23 formed of PFA, PTFE, FEP or the like is provided. The pressing roller 20 is rotatably held between the left and right side plates 31 in a state in which left and right end portions of the core metal 21 are supported by the left and right bearing members 32, respectively. At one end portion of the metal core 21, a driving gear G is fixed, and to this driving gear G, a rotational force is transmitted, so that the pressing roller 20 is rotated.

In the device casing (device body) 30, on the pressing roller 20 supported by the left and right side plates 31, the heating unit 9 is held via left and right flange members 15 as limiting members supported by the device casing 30. The left and right flange members 15 are mounted on left and right end portions, respectively, of a heat-insulating stay holder 12 as a predetermined member, and limit movement of the fixing belt 10, for heating the image on the sheet in the fixing nip N2, in the widthwise direction of the fixing belt 10. As shown in FIG. 3, the heating unit 9 is an assembly prepared by integrally assembling the heat-insulating stay holder 12 as the urging member, a ceramic heater 11, the fixing belt 10, the flange members 15 and the like into a unit.

The heat-insulating stay holder 12 is constituted by an elongated heat-resistant rigid member extending, in the widthwise direction (arrow J direction in FIG. 4) crossing (perpendicular to) a circumferential direction, inside the fixing belt 10, and nips the fixing belt 10 between itself and the pressing roller 20, thus forming the fixing nip N2. The heater 11 is constituted so as to be engaged in a heater accommodating recess-shaped groove portion 12*a* formed at an opposing portion to the pressing roller 20 of the heat-insulating stay holder 12 so as to extend in an extension direction (front-rear direction in FIG. 3) of the heat-insulating stay holder 12, and is constituted so as to generate heat by being supplied with electric power from an unshown power source. In an upstream side of the fixing nip N2 in FIG. 3, a heat-resistant fixing device entrance guide 24 is provided.

The heat-insulating stay holder 12 includes, as shown in FIG. 3, curved portions 12*g* formed so as to extend along an inner surface of the fixing belt 10 in a curved state with the heater accommodating recess-shaped groove portion 12*a* as a center of extension. In the heat-insulating stay holder 12, in a somewhat downstream side of the fixing nip N2, an expanded portion 12*f* somewhat expanded toward the pressing roller 20 is formed. That is, of the heat-insulating stay holder 12, a portion downstream of the fixing nip N2 is projected toward the pressing roller 20, so that the expanded portion 12*f* having a projected shape of, e.g., 1.0 mm in height is formed, and functions as a jaw portion for changing the curvature of the fixing belt 10. By this expanded portion 12*f*, the rotational shape of the fixing belt 10 is changed, so that the sheet P passed through the fixing nip N2 can be curvature-separated from the fixing belt 10.

The left and right flange members 15 as the limiting members support the end portions of the heating unit 9 between the left and right side plates 31 in a state in which the left and right flange members 15 are supported by the device casing (device body) 30. Each of the left and right flange members 15 limits movement of the fixing belt 10 in the widthwise direction in contact with the associated one of the end portions of the fixing belt 10 with respect to the widthwise direction in a state in which the fixing belt 10 is mounted around the heat-insulating stay holder 12.

Each of the left and right flange members 15 limits the movement of the fixing belt 10 in the widthwise direction in contact with an end portion 10*c* (FIG. 6) of the fixing belt 10 with respect to the widthwise direction (arrow J direction in FIG. 4). That is, each of the left and right flange members 15 limits lateral movement (shift) of the fixing belt 10 in the widthwise direction (generatrix direction) as described above in a state in which the flange member 15 is mounted on an outwardly extended portion 12*e* (FIG. 9) of the heat-insulating stay holder 12 in the associated one of the left and right sides.

Each of the left and right flange members 15 includes a fixed flange 15*b* as a first limiting member fixed in the device casing 30 and a rotatable flange 15*a* as a second limiting member. The rotatable flange 15*a* is a rotatable member, having an endless ring or disk shape, which is rotatably by contact with an end portion 10*c* (FIG. 9) of the fixing belt 10. The fixed flange 15*b* is a fixed member which is substantially fixed non-rotatably so as to limit movement of the rotatable flange 15*a* by the fixing belt 10 in the widthwise direction.

Figure 6:
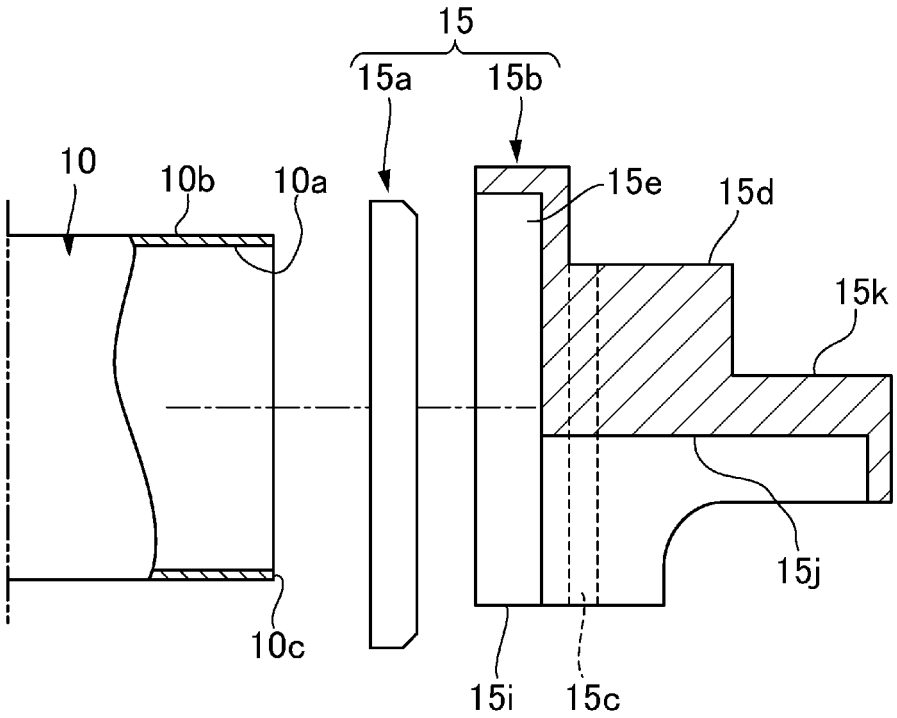
FIG. 6 is a sectional view showing a connecting portion between a fixing belt and a flange member.

That is, the fixed flange 15*b* limits the rotational position of the rotatable flange 15*a* while limiting the movement of the rotatable flange 15*a* in the widthwise direction (left-right direction in FIG. 6). The rotatable flange 15*a* is interposed between the fixed flange 15*b* and the end portion of the fixing belt 10 with respect to the widthwise direction, and is constituted rotatably relative to the fixed flange 15*b* while supporting the widthwise end portion of the fixing belt 10. The fixed flange 15*b* is the substantially non-rotatably fixed member for limiting the widthwise movement of the rotatable flange 15*a* (moved) by the fixing belt 10.

The heating unit 9 is mounted between the left and right side plates 31, in a state in which the heating unit 9 contacts the pressing roller 20 from above, by engaging a vertical engaging portion 15*c*, provided on each of the left and right fixed flange 15*b*, with the engaging groove 31*a* of the associated one of the left and right side plates as shown in FIGS. 2 and 4. The vertical engaging portion 15*c* and the engaging groove 31*a* function as a guide for limiting movement of the heating unit 9 so that the heating unit 9 slides and moves in a direction of the pressing roller 20 between the left and right side plates 31.

[Fixing Belt]

A specific structure of the fixing belt 10 will be described with reference to FIGS. 3 and 8. That is, as shown in FIG. 3, the fixing belt 10, which is the flexible heating belt, is externally fitted loosely around the heat-insulating stay holder 12 placed in the state in which the heater 11 is fixed and supported in the heater accommodating recess-shaped groove portion 12*a*.

Although a description will be provided specifically later, before the fixing belt 10 is mounted around the heat-insulating stay holder 12, a lubricant 100 is applied along the widthwise direction (arrow J direction in FIG. 8) onto a part of an inner surface 10*a* of the fixing belt 10 with respect to a circumferential direction of the fixing belt 10. The fixing belt 10 has visible markings (indicating portion or mark portion) 35, on an outer surface 10*b* thereof, positionally aligned so as to have a predetermined relationship with the lubricant 100 applied onto the part of the inner surface 10*a* with respect to the circumferential direction in order that the fixing belt 10 opposes the heat-insulating stay holder 12 during mounting thereof around the heat-insulating stay holder 12.

In this embodiment, the marking 35 is provided at each of the widthwise end portions of the outer surface 10*b* of the fixing belt 10, but the present invention is not limited thereto. It is also possible to provide the marking 35 at either one of the widthwise end portions. In that case, a marking 36 may only be required to be provided only on the fixed flange 15*b* in a side where an end of the fixing belt 10 provided with the marking 35 is inserted.

Further, the marking 35 as the indicating portion (guidance portion) can also be obtained by forming not only a single mark such as an arrow, but also two marks such as two lines indicating an applied region of the lubricant 100 or by forming a triangular cut-away portion at both end portions or one end portion of the fixing belt 10 with respect to the widthwise direction. That is, the specific shape of the marking 35 is not limited to those described above if the marking (mark) is capable of being recognized by an operator who makes exchange of the fixing belt.

[Flange Member and its Neighborhood of Fixing Device]

Figure 7:
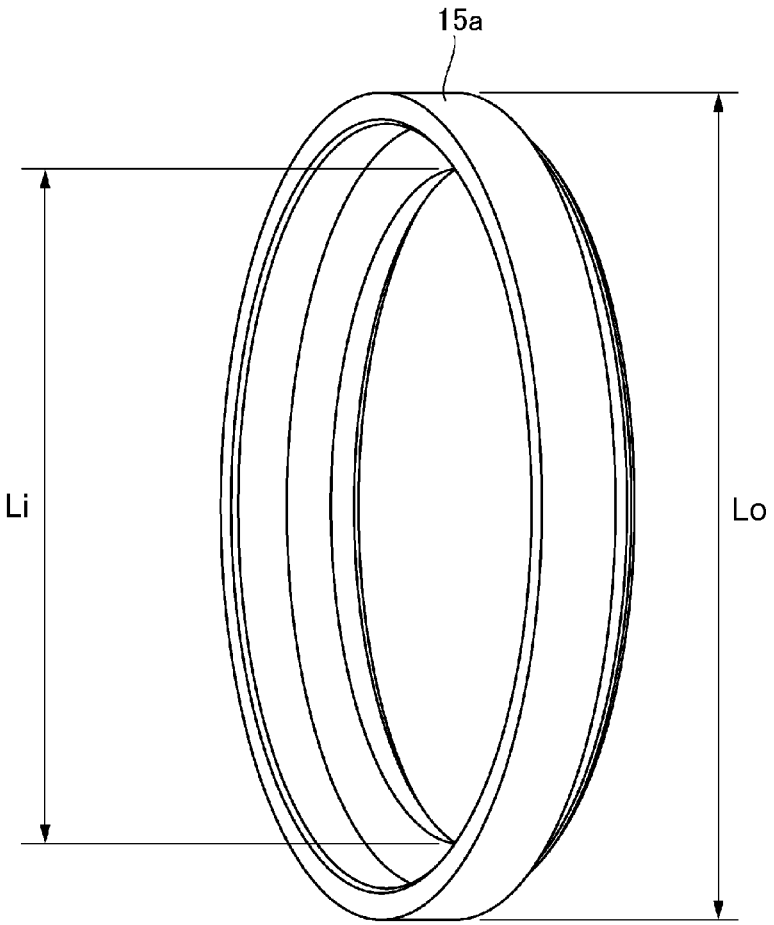
FIG. 7 is an enlarged perspective view of a rotatable flange.
Figure 9:
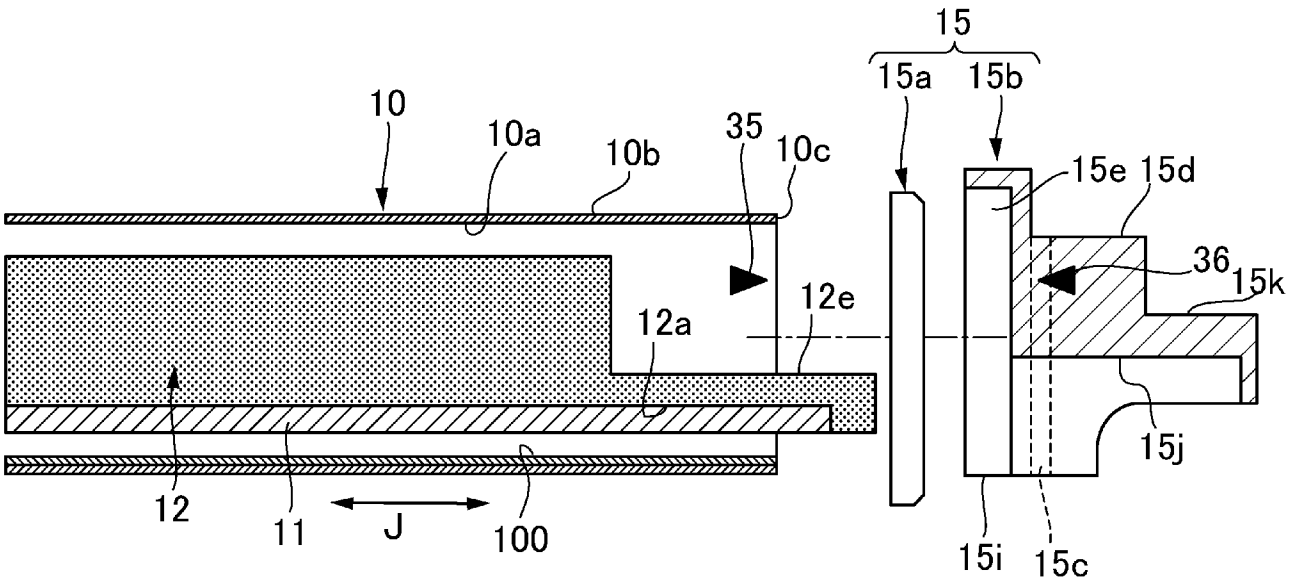
FIG. 9 is a schematic sectional view showing a fixing belt and the flange member in the First Embodiment.

With reference to FIGS. 2 to 4, 6, 7 and 9, the flange member 15 of the fixing device 6 and the neighborhood thereof will be described. FIG. 6 is a sectional view of the flange member 15 and the fixing belt 10, and FIG. 7 is an enlarged perspective view of the rotatable flange 15*a*. FIG. 9 is a schematic sectional view showing the fixing belt 10 and the flange member 15 in this embodiment.

As shown in FIGS. 4 and 6, the fixed flange 15*b* is formed, in a cap shape, using a heat-resistant resin material such as PPS, a liquid crystal polymer or a phenolic resin material, and is provided in an inner surface side thereof with a recessed inserting portion 15*e* set to have an inner diameter in which the rotatable flange 15*a* is insertable. The inner diameter of the recessed inserting portion 15*e* has a sufficient size such that the outer surface 10*b* of the fixing belt 10 does not contact an inner peripheral surface of the recessed inserting portion 15*e* even in the case where an outer peripheral configuration of the fixing belt 10 is deformed by the formation of the fixing nip N2.

The rotatable flange 15*a* is formed of the heat-resistant material such as PPS, the liquid crystal polymer or the phenolic resin material. The rotatable flange 15*a* is constituted in a ring-like cap shape as shown in FIG. 7, and the outer diameter Lo thereof is set so as to be smaller than the inner diameter of the recessed inserting portion 15*e* of the fixed flange 15*b* and to be larger than a cut-away portion 15*i* (FIG. 6). The fixed flange 15*b* constituted so that the fixed flange 15*b* is cut away as the cut-away portion 15*i*, which is a lower portion of the recessed inserting portion 15*e* in which the rotatable flange 15*a* is to be accommodated and so that the lower side of the accommodated rotatable flange 15*a* is projected outwardly.

The inner diameter Li of the rotatable flange 15*a* shown in FIG. 7 is set, in a state in which the heating unit 9 is mounted in the device casing 30 via the left and right flange members 15, to have a size such that the rotatable flange 15*a* does not interfere with an outwardly extended portion 12*e* (FIG. 9) outside the heater 11 extending in the left-right direction. That is, even when the outwardly extended portion 12*e* of the heat-insulating stay holder 12 is positioned in a range of the inner diameter Li in a penetration state, the rotatable flange 15*a* and the outwardly extended portion 12*e* of the heat-insulating stay holder 12 are maintained so as not to interfere with each other. In this constitution, the end portion (edge surface) 10*c* (FIGS. 6 and 9) of the fixing belt 10 is inscribed in the rotatable flange 15*a*, so that a frictional force is generated. As a result, the fixing belt 10 and the rotatable flange 15*a* rotate together, so that the edge surface of the fixing belt 10 is protected so as not to slide with the device casing 30.

As shown in FIGS. 2, 4, 6 and 9, each of the left and right fixed flanges 15*b* includes a pressing portion 15*d* and a projected portion 15*k*, which extended from the flange portion having the recessed inserting portion 15*e* toward the outside with respect to an axial direction in a stepwise manner. Inside the pressing portion 15*d* and the projected portion 15*k*, the inserting portion 15*j*, in which the outwardly extended portion 12*e* of the heat-insulating stay holder 12 is insertable, is formed.

As shown in FIGS. 2 and 3, at a position opposing each of the left and right pressing portions 15*d*, a spring receiving member 40 positioned relative to the device casing 30 via an unshown supporting means is provided. In each of the left and right sides of the heating unit 9, between the spring receiving member 40 and an upper surface of the pressing portion 15*d*, a pressing spring 17, which is a compression spring, is compressedly provided. As a result, the heating unit 9 including the fixing belt 10 is urged in an arrow I direction at each of the left and right end portions, so that the fixing belt 10 is press-contacted to an upper surface of the pressing roller 20 with a predetermined pressing force (predetermined pressure). At this time, the heating unit 9 is pressed against elasticity of the fixing belt 10 and the elasticity of the pressing roller 20, so that the fixing nip F2 having a predetermined width d is formed between the fixing belt 10 and the pressing roller 20.

In the fixing nip N2, by the pressure of the heating unit 9 applied to the pressing roller 20, the fixing belt 10 is sandwiched (nipped) between a lower surface (FIG. 3) of the heat-insulating stay holder 12 holding the heater 11 and the upper surface (FIG. 3) of the pressing roller 20. As a result, the fixing belt 10 flexes along a lower surface shape of the heat-insulating stay holder 12 as shown in FIG. 3, so that the fixing belt 10 is in a state in which the inner surface 10*a* of the fixing belt 10 is closely contacted to the lower surface of the heat-insulating stay holder 12 and a flat surface (lower surface) of the heater 11.

[Fixing Belt]

A specific structure of the fixing belt 10 will be described with reference to FIGS. 2 to 4. That is, as shown in FIGS. 2 to 4, the rotational force is transmitted from the driving portion 34 as a driving means to the driving gear G, so that the pressing roller 20 is rotationally driven at a predetermined rotational speed in the counterclockwise direction (arrow L direction in FIGS. 3 and 4). With this rotational driving of the pressing roller 20, a rotational force acts on the belt 10 by a frictional force between the pressing roller 20 and the fixing belt 10 in the fixing nip N2.

As a result, the fixing belt 10 is rotated around the heat-insulating stay holder 12 by rotation of the pressing roller 20 in the clockwise direction (arrow M direction in FIGS. 3 and 4) while sliding with the heater in a state in which the inner surface 10*a* of the fixing belt 10 is closely contacted to the lower surface of the heater 11. In this way, in this embodiment, the pressing roller 20 is constituted so as to be rotatable by the driving force of the driving portion 34, and the fixing belt 10 is rotated and moved by the rotation of the pressing roller 20, and therefore the fixing belt 10 can be rotated by the rotation of the pressing roller 20 with reliability.

The fixing belt 10 rotates while sliding with the inside heater 11 and the heat-insulating stay holder 12, and therefore there is a need to suppress the frictional resistance between the fixing belt 10 and each of the heater 11 and the heat-insulating stay holder 12 to a low level. For this reason, in this embodiment, the lubricant 100 such as heat-resistant grease is applied onto the surfaces of the heater 11 and the heat-insulating stay holder 12. As a result, the fixing belt 10 can be smoothly rotated relative to the heater 11 and the heat-insulating stay holder 12. The heater 11 melts the toner image T (FIG. 3) on the sheet P, and heats the fixing nip N2 where the toner image T is fixed.

With the rotation of the pressing roller 20, the fixing belt 10 is rotated, so that energization to the heater 11 is performed. As a result, in a state in which a temperature of the heater 11 is increased up to a predetermined temperature and is adjusted, the sheet P carrying thereon the (unfixed) toner image is sent into the fixing nip N2 along the fixing device entrance guide 24. When the sheet P passes through the fixing nip N2 while being nipped in the fixing nip N2, the (unfixed) toner image T is heated by receiving the heat from the heater 11 via the fixing belt 10, and is heat-fixed on the sheet P. The sheet P, after passing through the fixing nip N2, is separated from the outer surface 10*b* of the fixing belt 10 and is regulated by a heat-resistant sheet discharging guide (not shown) for the fixing device, so that the sheet P is discharged onto an unshown discharge tray.

The fixing belt 10 is a flexible sleeve having low a thermal capacity. Specifically, in order to enable the quick start of the image forming apparatus, the fixing belt 10 is prepared a sleeve by forming a base layer, in a total thickness of, e.g., 500 μm, of a metal member having a heat-resistance property and a high thermal conductivity, such as SUS (stainless steel), Al, Ni, Cu, Zn, or the like, or of an alloy member of these metal members. Further, in order to constitute a long-lifetime fixing apparatus 6, the metal sleeve which has a sufficient strength and which is excellent in durability, is required that the total thickness is, e.g., 30 μm or more. Accordingly, the total thickness of the fixing belt 10 in the range of 30 μm or more and 500 μm or less is optimum.

Further, in order to ensure an offset preventing property and a sheet separating property, a surface layer of the fixing belt 10 is coated with a parting layer of a heat-resistant resin, having a good parting property, such as a fluorine-containing resin, silicone resin or the like which are used singly or in mixture. Examples of the heat-resistant resin may include PTFE (polytetrafluoroethylene), PFA (tetrafluoroethylene-perfluoroalkylvinyl ether copolymer), FEP (tetrafluoroethylene-hexafluoropropylene copolymer), ETFE (ethylene-tetrafluoroethylene copolymer), CTFE (polychlorotrifluoroethylene), and PVDF (polyvinylidene fluoride).

As a coating method, dipping of the parting layer after etching of the outer surface of the base material of the metal sleeve, application such as powder spraying, a method in which the surface of the metal sleeve is coated with a tube-like resin material, a method in which the outer surface of the metal sleeve is blasted, and thereafter a primer layer of an adhesive is applied and then the parting layer is coated on the primer layer, or a method in which on an inner surface of the metal sleeve contacting the heater 11, a high-lubricating property layer such as a fluorine-containing layer, a polyimide layer or a polyamideimide layer may be used.

As the heater 11 for heating the fixing nip N2 in which the toner image is melted and fixed on the sheet P, an energization heating member formed in the following manner. An electric heat generating resistance layer is formed by screen printing or the like on, e.g., a surface of a high heat-insulating ceramic substrate of alumina, AlN (aluminum nitride) or the like or a surface of a heat-resistant resin substrate of polyimide, PPS, a liquid polymer or the like along a widthwise direction. The electric heat generating resistance layer is formed by screen printing or the like of, e.g., Ag/Pd (silver-palladium), $RuO_2$, $Ta_2N$ or the like. In the screen printing (coating), the electric heat generating resistance layer is formed in a line shape or a fine stripe shape of, e.g., about 10 μm in thickness and about 1-5 mm in width.

[Heater]

Figure 5:
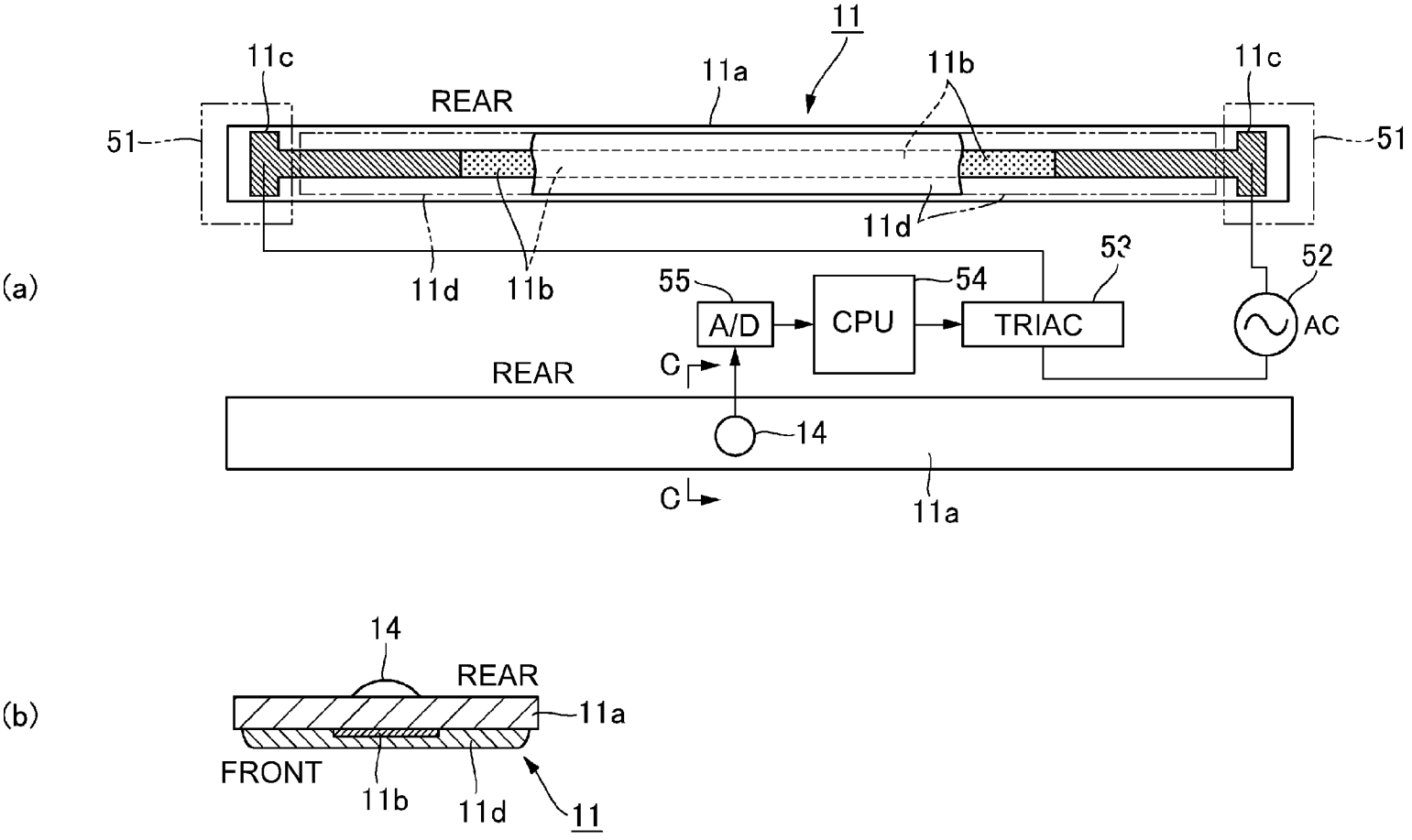
In FIG. 5, (a) and (b) are schematic illustrations showing an example of a heater.

A specific structure of the heater 11 will be described with reference to FIG. 5. In FIG. 5, (a) is a schematic illustration of the heater 11, and (b) is a sectional view of the heater 11 taken along C-C line in (a) of FIG. 11. In (a) of FIG. 5, an upper-side heater 11 is in a partly-cutaway state showing an inside of a ceramic substrate 11*a* as seen from a rear (back) surface-side of the heater 11, and a lower-side heater 11 in a state in which the inside of the ceramic substrate 11*a* is not shown and a temperature detecting element 14 is provided on an upper surface of the ceramic substrate 11*a*.

As shown in FIG. 5, the heater 11 includes an elongated ceramic substrate (heater substrate) 11*a* formed of heat-insulating ceramics such as alumina, AlN or silicon carbide. Further, the heater 11 includes the electric heat generating resistance layer 11*b* formed by the screen printing or the like on the surface of the ceramic substrate 11*a* along the longitudinal direction (widthwise direction). The electric heat generating resistance layer 11*b* is constituted by a layer of, e.g., Ag/Pd (silver-palladium), $RuO_2$, $Ta_2N$ or the like, formed by being coated and baked in a line shape or a fine stripe shape of about 10 μm in thickness and about 1-5 mm in width.

Further, the heater 11 includes an electrode portion 11*c* formed of Ag/Pt (silver-platinum) so as to be electrically conducted to longitudinal end portions of the electric heat generating resistance layer 11*b*. The heater 11 further includes an insulating protective layer 11*d*, formed in a thin layer of glass coating or fluorine-containing resin coating, which is formed on the surface of the electric heat generating resistance layer 11*b* and which is electrically insulative and capable of withstanding slide with the metal-made fixing belt 10. The heater 11 further includes the temperature detecting element 14, such as a thermistor, provided on the back surface (rear surface) of the ceramic substrate 11*a*.

In the front surface-side of the heater 11, the insulating protective layer 11*d* is provided, and the fixing belt 10 slides with the surface thereof. The heater 11 is engaged in the heater accommodating recess-shaped groove portion 12*a* (FIG. 3) provided at the lower surface of the heat-insulating stay holder 12 along the longitudinal direction of the holder 12, and is bonded by a heat-resistant adhesive, thus being held.

An energizing connector 51 is mounted at each of the end portions of the heater 11 projected from the left and right side plates 11. The energizing connector 51 is engaged with the electrode portion 11*c* at each of the end portions of the heater 11 fixed and supported by the heat-insulating stay holder 12, so that an electric contact of the energizing connector 51 is in a contact state with the associated electrode portion 11*c*.

One of the electrode portions 11*c* is connected with a triac 53, and the other electrode portion 11*c* is connected with the triac 53 via a commercial power source (AC) 52. The temperature detecting element 14 as a temperature detector mounted on the heater back surface of the ceramic substrate 11*a* detects the degree of the temperature rise of the heater 11 and sends a detection signal to an analog/digital (A/D) conversion circuit 55. That is, the temperature rise of the heater 11 is detected by the temperature detecting element 14, and electric analog information of a detected temperature is inputted into the analog/digital conversion circuit 55. The thus-digitized information is inputted into an electric power control means 54 including a CPU. DC energization from the temperature detecting element 14 to the electric power control means (temperature controller) 54 is achieved by an unshown connector via an unshown DC energizing portion and an unshown electrode portion.

The electric power control means 54 to which the signal is sent from the analog/digital conversion circuit 55 executes temperature adjustment of the heater 11 by controlling the triac 53 on the basis of the signal. As a result, the heater 11 is supplied with electric power from the commercial power source 52 to between the electrode portions 11*c* via the triac 53, so that the electric heat generating resistance layer 11*b* generates heat and quickly and abruptly increases in temperature.

The electric power control means 54 properly controls a duty ratio, the wave number and the like of a voltage applied from the electric portions 11*c* provided at the longitudinal end portions of the heater 11 to the electric heat generating resistance layer 11*b* depending on the signal from the temperature detecting element 14. As a result, a target temperature temperature) in the fixing nip N2 is kept at a substantially constant value, so that heating necessary to fix the toner image on the sheet P can be effected. That is, the electric power control means 54, into which the digital information depending on the detected image by the temperature detecting element 14 is inputted, controls the energization from the commercial power source 52 to the electric heat generating resistance layer 11*b* so that the detected temperature by the temperature detecting element 14 is a value with a predetermined range from the target temperature.

As the control of the energization from the commercial power source 52 to the electric heat generating resistance layer 11*b* by the electric power control means 54, it is possible to employ phase control or wave-number control. The phase control is control in which a phase range subjected to the energization from the commercial power source 52 to the electric heat generating resistance layer 11*b* is changed depending on the detected temperature by the temperature detecting element 14 every half-wave period of an AC voltage outputted from the commercial power source 52. Further, the wave-number control is control in which the energization from the commercial power source 52 to the electric heat generating resistance layer 11*b* is switched to a conduction state or a blocked (interrupted) state depending on the detected temperature by the temperature detecting element 14 every half-wave period.

In the case where the ceramic substrate 11*a* formed of AlN, which has excellent anti-wearing property and which has a good heat-conductive property, is used, the electric heat generating resistance layer 11*b* may also be formed in a side opposite from the fixing nip N2 with respect to the ceramic substrate 11*a*. The heat-insulating stay holder 12 has the function of supporting the heater 11, the function of a rotation regulating member for the fixing belt 10, the function of an urging member and the function of a heat-insulating member for preventing heat dissipation in a direction opposite to the fixing nip N2. The heat-insulating stay holder 12 is constituted by a member, having rigidity, a heat-resistant property and a heat-insulating property, such as the liquid crystal polymer, phenolic resin, PPS or PEEK.

[Lubricant for Fixing Belt and Marking]

Figure 8:
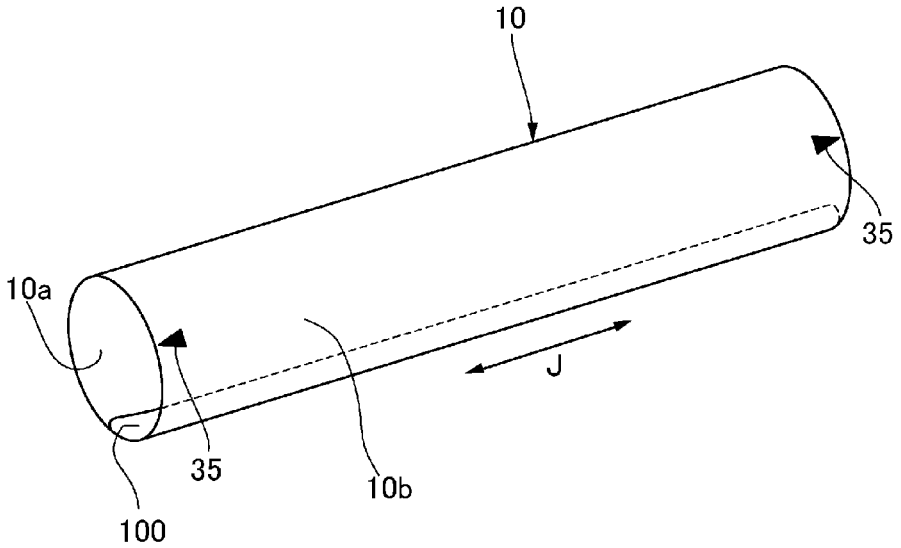
FIG. 8 is a schematic perspective view of the fixing belt in the First Embodiment.

With reference to FIGS. 8 and 9, the lubricant 100 for the fixing belt 10 and the markings 35 and 36 will be described. FIG. 8 is a schematic perspective view showing the fixing belt 10 in this embodiment.

As shown in FIGS. 8 and 9, in the fixing belt 10 to be newly mounted or replaced, onto a part of an inner surface 10*a* with respect to a circumferential direction before the fixing belt 10 is mounted around the heat-insulating stay holder 12, the lubricant 100 is applied along the widthwise direction (arrow J direction in FIGS. 8 and 9). The fixing belt 10 has the markings 35, on its outer surface 10*b*, positioned to have a predetermined positional relationship with the lubricant 100 applied onto the part of the inner surface 10*a* with respect to the circumferential direction so that the lubricant 100 opposes the heat-insulating stay holder 12 during mounting of the fixing belt 10 around the heat-insulating stay holder 12. The markings 35 are constituted as a visible indicating portion (mark portion). In order to apply the lubricant 100 in a proper amount, it is desirable that the lubricant 100 is applied in advance during manufacturing or shipping of the fixing belt 10.

On the surface of the fixing belt 10 at the end portions, the markings 35 as the visible indicating portion (mark portion) are formed by printing or marking (imprinting). The markings 35 are provided at positions of a predetermined angle from a region where the lubricant 100 is applied as seen from the cross-section of the fixing belt 10. The markings 35 may desirably be disposed at end portions (non-sheet-passing regions) outside a region of a maximum sheet passing width of the sheet P usable in the fixing device 6.

As shown in FIG. 9, similarly, also the left and right fixed flanges 15*b* for limiting the fixing belt 10 are provided with the markings 36, respectively, as second indicating portions. The respective markings are provided so that the lubricant 100 on the inner surface 10*a* is in a contact position with the developer 11 and the heat-insulating stay holder 12 when the fixing belt 10 is mounted around the heat-insulating stay holder 12 so that the markings 35 and the markings 36 are aligned with each other.

That is, the left and right flange members 15 as the limiting member are provided with the markings 36 as the second indicating portions for positioning the flange members 15 relative to the heat-insulating stay holder 12 with respect to the circumferential direction of the fixing belt 10 at least during mounting of the fixing belt 10. The markings 36 are visibly provided so that the lubricant 100 applied onto the part of the inner surface 10*a* with respect to the circumferential direction can oppose the heat-insulating stay holder 12 when the markings 35 are aligned with the markings 36 during mounting of the fixing belt 10.

In the fixing device 6 having the above-described constitution, when the fixing belt 10 is newly mounted or exchanged, the lubricant 100 is applied in a proper amount onto the surfaces of the heater 11 and the heat-insulating stay holder 12. In that case, in a belt mounting method, first, a first step is carried out of providing the markings 35 as a visible indicating portion on the outer surface 10*b* of the fixing belt 10 before the fixing belt 10 is mounted around the heat-insulating stay holder 12. Subsequently, a second step is carried out of applying the lubricant 100, onto the part of the inner surface 10*a* of the fixing belt 10 with respect to the circumferential direction before the mounting of the fixing belt 10 around the heat-insulating stay holder, along the widthwise direction (arrow J direction) so that the lubricant 100 has the predetermined positional relationship with the markings 35.

Then, a third step of mounting the fixing belt 10 while visually observing the markings 35 by moving the fixing belt 10 so that the lubricant 100 on the inner surface 10*a* of the fixing belt 10 moves along the heat-insulating stay holder 12 is carried out. In this embodiment, the markings 36 associated with the markings 35 are provided on the fixed flanges 15*b*. For this reason, in order to align the positions of the markings (indicating portions) 35 with the positions of the markings 36 through eye observation, the fixing belt 10 is moved and mounted so that the lubricant 100 on the inner surface 10*a* thereof moves along the heat-insulating stay holder 12 and the heater 11.

In this way, the fixing belt 10 is fitted around the heat-insulating stay holder 12 so that the markings 35 at the end portions of the fixing belt 10 and the markings 36 on the fixed flanges 15*b* are aligned with each other, so that the lubricant 100 can be supplied to the heater 11 and the heat-insulating stay holder 12 with reliability. As a result, the lubricant 100 can be uniformly applied in a proper amount with reliability, so that it becomes possible to stably maintain a sliding property between the fixing belt 10 and the heat-insulating stay holder 12 (and the heater 11) in a good state.

In this embodiment, in the fixing belt 10 before being fixed in the fixing device 6, the lubricant 100 is applied onto the part of the inner surface 10*a* with respect to the circumferential direction along the widthwise direction (arrow J direction). In addition, the fixing belt 10 has the markings 35 for indicating a mounting attitude (mounting phase) of the fixing belt 10 to the operator so that the fixing belt 10 has a predetermined positional relationship with the lubricant 100 with respect to the circumferential direction and so that the lubricant 100 has an opposing positional relationship with the heat-insulating stay holder (urging member) 12. The fixing belt 10 as a replacement part is an exchanging (replacing) heating belt, detachably mountable to the fixing device 6, for heating the image on the sheet. In the fixing belt 10, the lubricant 100 is applied along the widthwise direction (arrow J direction) onto the part of the inner surface 10*a* with respect to the circumferential direction, and the fixing belt 10 has the markings (indicating portions) 35, disposed to have the predetermined positional relationship with the lubricant 100 with respect to the circumferential direction, for indicating the mounting attitude to the operator.

As described above, when the fixing belt (heating belt) 10 is newly mounted or replaced, it becomes possible to uniformly apply the lubricant 100 in a proper amount on the surface of the mounting portion, so that it becomes possible to maintain a good sliding property of the fixing belt 10.

Modified Embodiment 1

Figure 10:
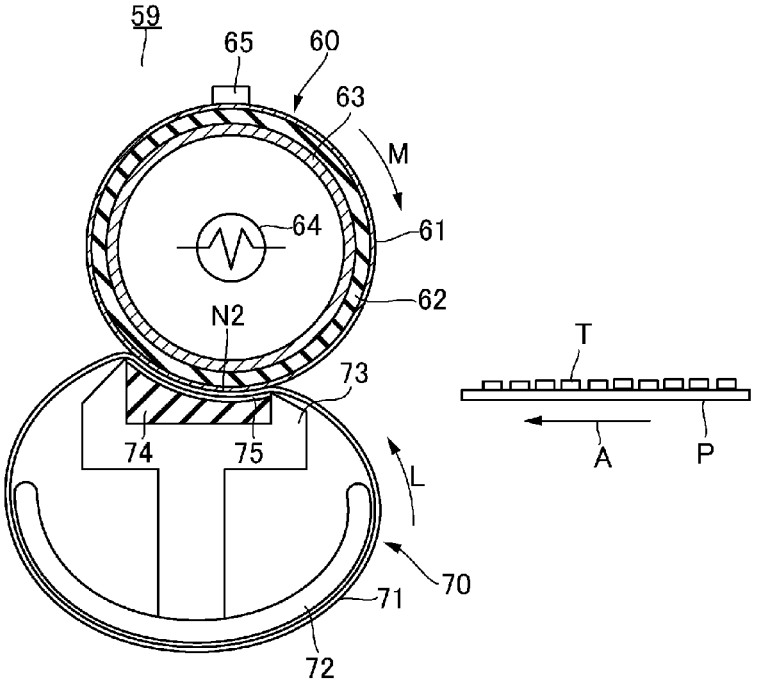
FIG. 10 is a sectional view for illustrating a Modified Embodiment 1.

Modified Embodiment 1 in which First Embodiment is modified will be described with reference to FIG. 10. FIG. 10 is a sectional view showing a fixing device 59 having a pressing belt constitution in Modified Embodiment 1.

In the First Embodiment described above, a constitution in which the fixing belt 10 and the pressing roller 20 are opposed to each other is employed, but in place thereof, it is also possible to employ a constitution as shown in FIG. 10. That is, the fixing device 59 shown in FIG. 10 has a constitution in which a fixing roller 60 and a pressing belt 70 are provided oppositely to each other. The fixing roller 60 includes a metal core 63 extending in an axial direction, an elastic layer 62 provided on an outer peripheral surface of the metal core 63, and a parting layer 61 provided on an outer peripheral surface of the elastic layer 62. The fixing roller 60 includes a heater 64 such as a halogen heater at a center portion of the metal core 63. The surface temperature of the fixing roller 60 increased by being heated by the heater 64 is detected by a temperature detecting member 65 such as a thermistor.

The pressing belt 70 disposed under the fixing roller 60 so as to oppose the fixing roller 60 is engaged with a stay holder 73 having a sliding surface 72 at a lower portion thereof so that the pressing belt 70 is slidable with an outer surface of the stay holder 73. The stay holder 73 supporting the pressing belt 70 from an inside of the pressing belt 70 includes an elastic supporting member 74 at a portion corresponding to a fixing nip N2 formed between the elastic supporting member 74 and the fixing roller 60. When the pressing belt 70 is newly mounted or replaced, a lubricant 75 is uniformly applied in a proper amount on the surface of the elastic supporting member 74.

In the fixing device 59 having such a constitution, when the fixing roller 60 is rotated in an arrow M direction in FIG. 10 by a rotational force from a driving portion (not shown) such as a motor, the pressing belt 70, generating a frictional force between itself and the fixing roller 60, is moved and rotated in an arrow L direction by the fixing roller 60. As a result, by pressing and heating the toner image T on the sheet P, at the fixing nip N2, fed in an arrow A direction.

In the fixing device 59 in Modified Embodiment 1, the markings 35 described in the First Embodiment are provided on the outer surface of the pressing belt 70 from the same viewpoint as in the First Embodiment. Further, the markings 36 described in the First Embodiment are provided on at least one of left and right flange members (not shown) for supporting the pressing belt 70 at end portions of the pressing belt 70. That is, the markings 36 are provided on a member provided at a position where a positional relationship between the markings 36 and the lubricant 100 in the fixing belt 10 can be unambiguously determined. As a result, an effect similar to the effect in the First Embodiment can be obtained.

Modified Embodiment 2

Figure 11:
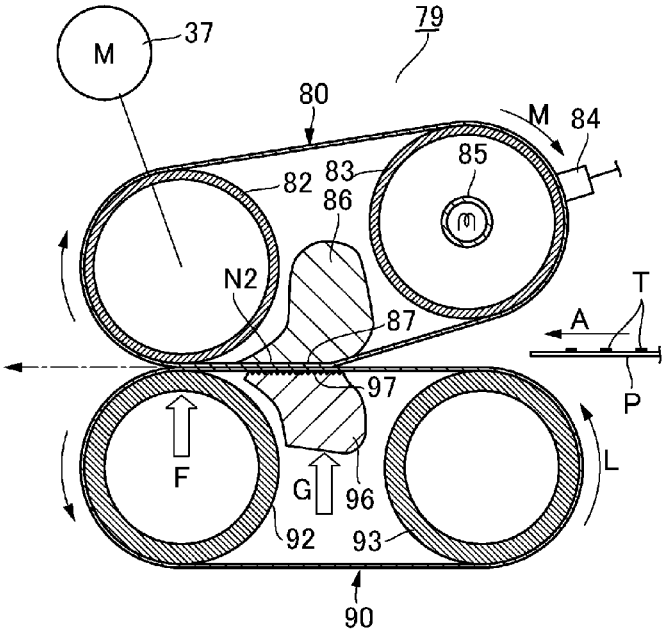
FIG. 11 is a sectional view for illustrating a Modified Embodiment 2.

Modified Embodiment 2 in which the First Embodiment is modified will be described with reference to FIG. 11. FIG. 11 is a sectional view showing a fixing device 79 having a fixing belt constitution and a pressing belt constitution in the Modified Embodiment 2.

The fixing device 79 shown in FIG. 11 has a constitution in which a fixing belt 80 and a pressing belt 90 are provided oppositely to each other. The fixing belt 80 is stretched by a driving roller 82 and a heating roller 83, which are supported by a device casing (not shown) in a state in which a predetermined distance is ensured between the rollers 82 and 83. The driving roller 82 is rotated in an arrow M direction by a rotating force from a driving portion 37 such as a motor M. A heater 85, such as a halogen heater, is provided at a center portion of the heating roller 83. The surface temperature of the fixing belt 80 increased by being heated by the heater 85 is detected by a temperature detecting member 84 such as a thermistor. Between the driving roller 82 and the heating roller 83, a stay holder 86 for supporting the inner surface of the fixing belt 80 toward the pressing belt 90 is provided.

The pressing belt 90 is stretched by stretching rollers 92 and 93 supported by a device casing (not shown) in a state in which a predetermined distance is ensured between the rollers 92 and 93, and the stretching roller 92 is pressed in an arrow F direction by an unshown pressing means. Between the stretching rollers 92 and 93, a stay holder 96 for supporting the inner surface of the pressing belt 90 toward the fixing belt 80 (arrow G direction) is provided.

In the fixing belt 80 side, when the fixing belt 80 is newly mounted or replaced, a lubricant 87 is uniformly applied in a proper amount onto the lower surface of the stay holder 86. Further, in the pressing belt 90 side, when the pressing belt 90 is newly mounted or replaced, a lubricant 97 is uniformly applied in a proper amount on the upper surface of the stay holder 96.

In the fixing device 79 having such a constitution, when the driving roller 82 is rotated to rotate the fixing belt 80 in an arrow M direction, the pressing belt 90, generating a frictional force between itself and the fixing belt 80, is rotated in an arrow L direction by the fixing belt 80. As a result, by pressing and heating the toner image T on the sheet P, at the fixing nip N2, fed in an arrow A direction.

In the fixing device 79 in the Modified Embodiment 2, the markings 35 described in the First Embodiment are provided on the outer surface of the fixing belt 80 from the same viewpoint as the First Embodiment. Further, the markings 36 described in the First Embodiment are provided on at least one of left and right flange members (not shown) for supporting the fixing belt 80 at end portions of the fixing belt 80. That is, the markings 36 are provided on a member provided at a position where a positional relationship between the markings 36 and the lubricant 100 in the fixing belt 10 can be unambiguously determined. For example, the markings 36 can be provided on an unshown stay (side plate) for supporting the driving roller 82 and the heating roller 83. As a result, an effect similar to the effect in the First Embodiment can be obtained. Incidentally, such a constitution is also applicable to the pressing belt 90 side.

Second Embodiment

Figure 12:
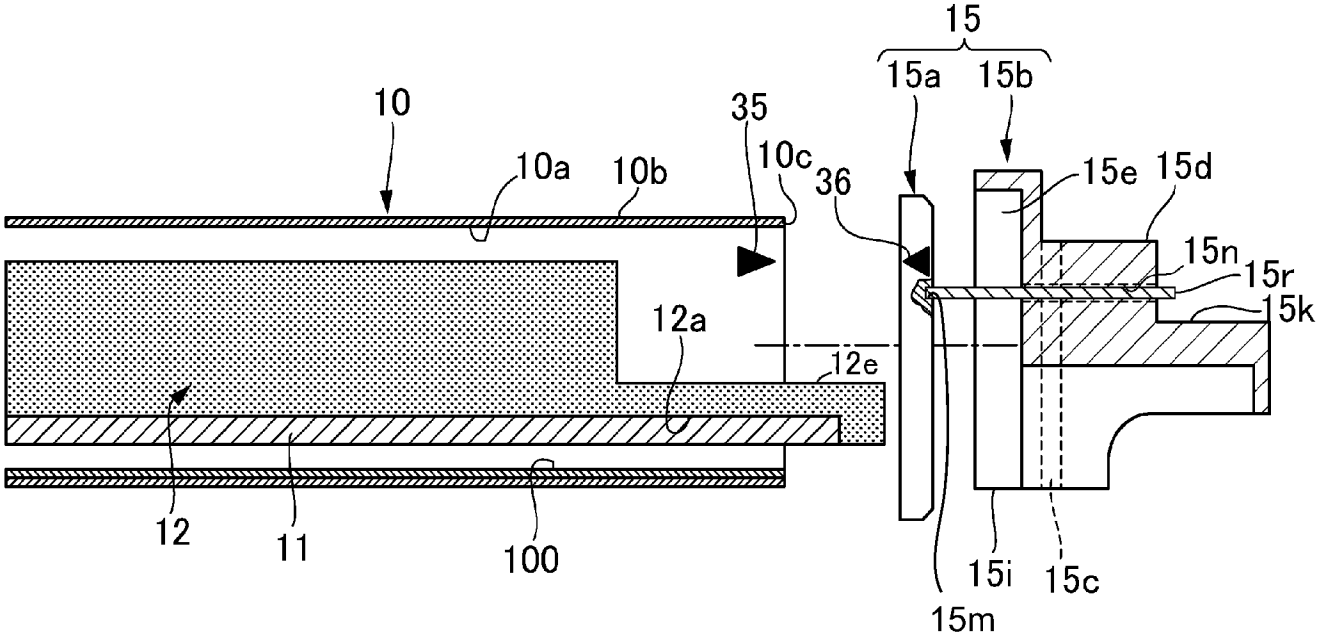
FIG. 12 is a schematic sectional view showing a fixing belt and a flange member in a Second Embodiment.

The Second Embodiment of the present invention will be described with reference to FIG. 12. This Embodiment is different from the First Embodiment only in that a positioning means for positioning a rotatable flange 15*a* is provided, and therefore the difference will be principally described. In FIG. 12, members identical to those in the First Embodiment are represented by the same reference numerals or symbols, and members having the same constitutions and functions as those in the First Embodiment will be omitted from description.

That is, as shown in FIG. 12, the markings 35 are provided on the fixing belt 10 at end portions of the fixing belt 10, and the markings 36 are provided on the left and right rotatable flanges 15*a*. Also in this embodiment, the markings 35 can be provided on the outer surface 10*b* of the fixing belt 10 at either one or both of the end portions of the fixing belt 10 with respect to the widthwise direction of the fixing belt 10. In that case, the marking 36 is provided only on the rotatable flange 15*a* where an end of the fixing belt 10 having the marking 35 is inserted.

In this embodiment, the rotatable flange 15*a* and the fixed flange 15*b* of each of the left and right flange members 15 have substantially the same constitutions as those in FIG. 9. Further, a positioning means for positioning the fixing belt 10 relative to the fixed flange (first limiting member) 15*b* is provided so that the rotatable flange (second limiting member) 15*a* is positioned during mounting of the fixing belt 10 relative to the heat-insulating stay holder 12 with respect to the circumferential direction of the fixing belt 10. Further, in this embodiment, as described above, the marking 36 as the second indicating portion is provided on the rotatable flange 15*a*.

The positioning means includes a fixing pin as a locking member detachably mountable to the fixed flange (first limiting member) 15*b*. Further, the positioning means includes a recessed portion 15*m* as a portion-to-be-locked provided in the rotatable flange 15*a* to position the rotatable flange 15*a* in a state in which the rotatable flange 15*a* is locked by the fixing pin (locking member) 15*r*.

The fixed flange 15*b* is provided with a through hole 15*n* through which the elongated fixing pin 15*r* can penetrate along an axial direction in a state in which the fixed flange 15*b* is held by the device casing. The recessed portion 15*m* is provided in the following position at a rear surface of the rotatable flange 15*a* directed toward the fixed flange 15*b*. That is, the recessed portion 15*m* is provided in a position where the rotatable flange 15*a* is positioned on the fixed flange 15*b* relative to the heat-insulating stay holder 12 with respect to the circumferential direction of the fixing belt 10 during the mounting of the fixing belt 10.

The respective markings are provided in the following manner in a state in which the rotatable flange 15*a* and the fixed flange 15*b* are fixed by the fixing pin 15*r*. That is, the fixing belt 10 is mounted in the fixed flange 15*b* so that the marking 35 and the marking 36 are aligned with each other, so that the lubricant 100 on the inner surface 10*a* of the fixing belt 10 is in a position where the lubricant 100 contacts the heat-insulating stay holder 12 and the heater 11 with reliability. The markings 35 and 36 are disposed in such a manner.

By employing the constitution described above, when the fixing belt 10 is assembled with the heat-insulating stay holder 12, the fixing pin 15*r* engages with the recessed portion 15*m* at the rear surface of the rotatable flange 15*a* in a state in which the fixing pin 15*r* is penetrated through the through hole 15*n* of the fixed flange 15*b*. As a result, the rotatable flange 15*a* is integrally fixed to the fixed flange 15*b*. Then, in the same procedure as that in the First Embodiment, the fixing belt 10 is moved and mounted so that the marking 35 is aligned with the marking 36 of the rotatable flange 15 through eye observation and so that the lubricant 100 on the inner surface 10*a* of the fixing belt 10 moves along the heat-insulating stay holder 12 and the heater 11. When the assembling of the fixing belt 10 with the heat-insulating stay holder 12 is ended, the fixing pin 15*r* is removed from the rotatable flange 15*a* and the fixed flange 15*b*, and therefore the heat-insulating stay holder 12 can support the fixing belt 10 in a state in which the rotatable flange 15*a* is rotatable relative to the fixed flange 15*b*.

Further, by inserting the fixing belt 10 so that the marking 35 of the fixing belt 10 and the marking 36 of the rotatable flange 15*a* are aligned with each other, the lubricant 100 is supplied to the heater 11 and the heat-insulating stay holder 12 with reliability. For this reason, it becomes possible to uniformly apply the grease in a proper amount with reliability, so that the sliding property between the fixing belt 10 and the heat-insulating stay holder 12 (and the heater 11) can be stably maintained in a good state.

In this embodiment, the markings 35 and 36 are provided on the fixing belt 10 and the rotatable flange 15*a*, rotating together with the fixing belt 10, respectively, but, e.g., the following member can also be used in place of the rotatable flange 15*a*. The present invention is applicable to also a rotatable member, such as a driving gear for driving the fixing belt 10, rotatable together with the fixing belt 10. In that case, it is desirable that a member or means, such as a cut-away portion, a fixing pin or press-fitting means, for enhancing bonding between the fixing belt 10 and the rotatable member.

Third Embodiment

Figure 13:
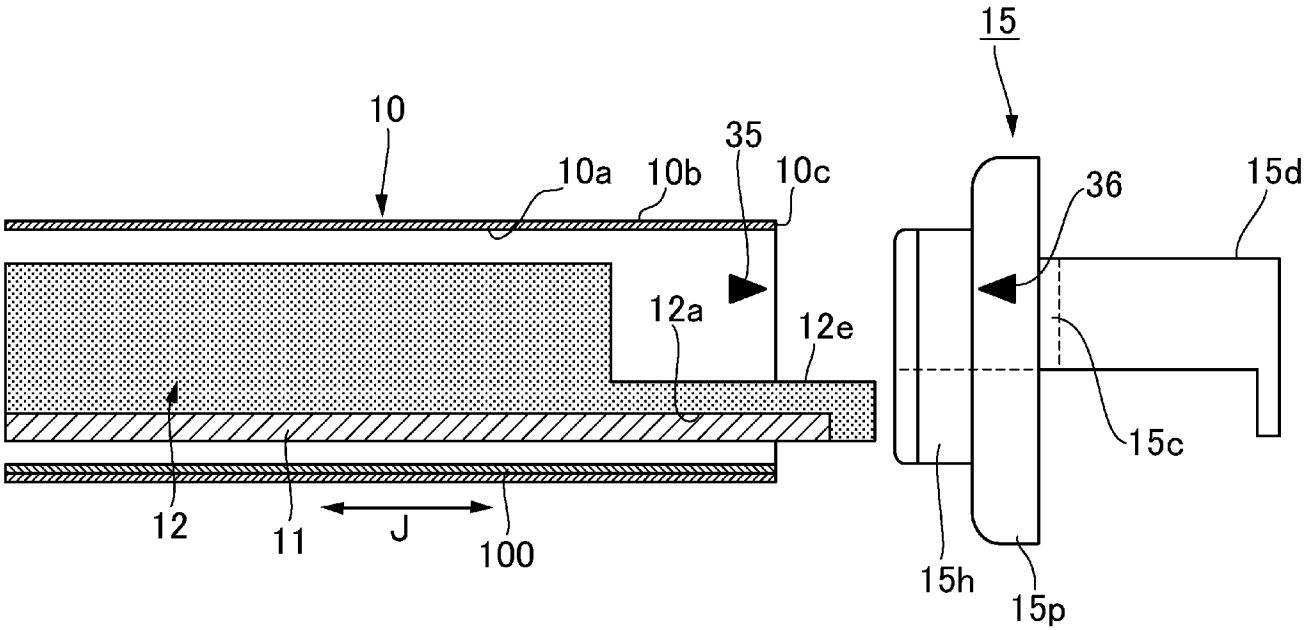
FIG. 13 is a schematic sectional view showing a fixing belt and a flange member in a Third Embodiment.

The Third Embodiment of the present invention will be described with reference to FIG. 13. This Embodiment is different from the First Embodiment only in that a marking 36 is provided on an integral-type flange member 15 supporting the fixing belt 10 while sliding with the fixing belt 10, and therefore the difference will be principally described. In FIG. 13, members identical to those in the First Embodiment are represented by the same reference numerals or symbols, and members having the same constitutions and functions as those in First Embodiment will be omitted from description.

In this embodiment, as shown in FIG. 13, each of the left and right flange members 15 does not include the rotatable flange 15*a* and the fixed flange 15*b* which are shown in FIGS. 6, 9 and 12, but has an integral structure including these flanges. This flange member 15 includes a large-diameter flange portion 15*p*, a sliding supporting portion 15*h*, which has a diameter smaller than the diameter of the flange portion 15*p* and which projects toward the fixing belt 10, and a pressing portion 15*d* projecting in an opposite side from the sliding supporting portion 15*h*.

The flange member (limiting member) 15 having the constitution engages with a widthwise end portion 10*c* of the fixing belt 10 in the mounted state around the heat-insulating stay holder 12, and thus limits movement of the fixing belt 10 in the widthwise direction (arrow J direction) while sliding with the fixing belt 10. That is, the sliding supporting portion 15*h* engages with the end portion of the fixing belt 10 at an outer peripheral surface thereof and slides with the inner surface 10*a* of the fixing belt 10, so that a locus of the fixing belt 10 with respect to the rotational direction and lateral movement of the fixing belt 10 in the widthwise direction can be limited.

Further, the markings 35 are provided at the end portions of the fixing belt 10, respectively, and the markings 36 are provided on the left and right flange members 15, respectively. The respective markings are provided similarly as in the First Embodiment. That is, when the fixing belt end portion is moved toward and engaged with the sliding supporting portion 15*h* so that the markings 35 of the fixing belt 10 and the markings 36 of the flange members 15 are aligned with each other, the lubricant 100 on the inner surface 10*a* of the fixing belt 10 in a position where the lubricant 100 contacts the heat-insulating stay holder 12 and the heater 11.

As a result, by inserting the fixing belt 10 so that the marking 35 of the fixing belt 10 and the marking 36 of the left and right flange members 15 are aligned with each other, the lubricant 100 can be supplied to the heater 11 and the heat-insulating stay holder 12 with reliability. For this reason, it becomes possible to uniformly apply the grease in a proper amount with reliability, so that the sliding property between the fixing belt 10 and the heat-insulating stay holder 12 can be stably maintained in a good state.

Fourth Embodiment

Figure 14:
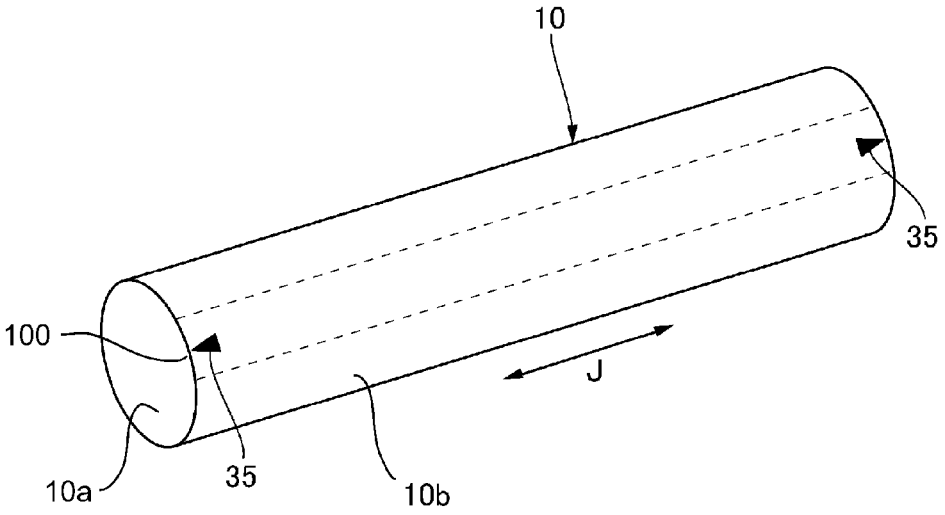
FIG. 14 is a schematic perspective view showing a fixing belt in a Fourth Embodiment.
Figure 15:
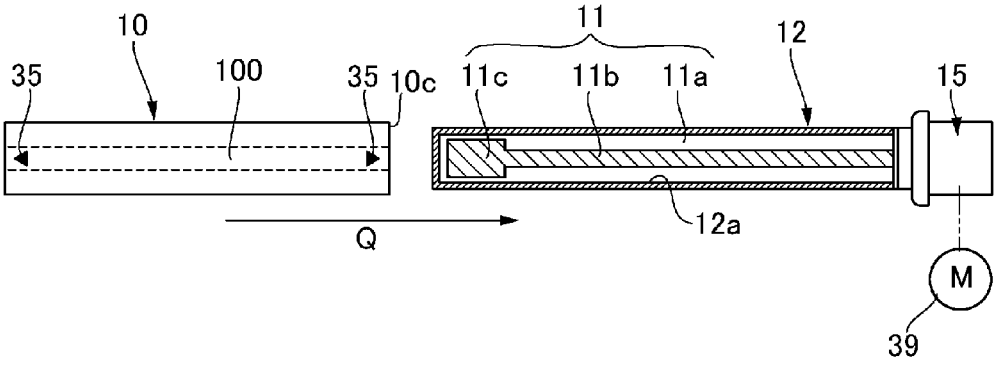
FIG. 15 is a schematic illustration showing a positional relationship between the fixing belt and a heater in the Fourth Embodiment.

The Fourth Embodiment of the present invention will be described with reference to FIGS. 14 and 15. This Embodiment is different from the First Embodiment only in the positional relationship between the markings 35 and the lubricant 100 and the rotational drive constitution of the fixing belt 10, and therefore the difference will be principally described. In FIGS. 14 and 15, members identical to those in the First Embodiment are represented by the same reference numerals or symbols, and members having the same constitutions and functions as those in the First Embodiment will be omitted from description.

That is, in the fixing belt 10 in this embodiment, the markings (indicating portions) 35 are, as shown in FIG. 14, provided at positions aligned with the lubricant 100, with respect to the circumferential direction, applied onto the part of the inner surface 10*a* of the fixing belt 10 with respect to the circumferential direction before the mounting of the fixing belt 10. That is, onto the part of the inner surface 10*a* of the fixing belt 10, the lubricant 100 is applied over a rotational axis direction (widthwise direction) so as to be aligned with the markings 35 disposed on the outer surface 10*b* of the fixing belt 10. The markings 35 are disposed on the end portion surface of the fixing belt 10 in a region in which the lubricant 100 is applied onto the inner surface 10*a* of the fixing belt 10.

The left and right flange members (limiting members) 15, supported by the device casing 30 (FIGS. 3 and 4) as the device body, for limiting movement of the fixing belt 10 in the widthwise direction in contact with the widthwise end portion 10*c* of the fixing belt 10 are provided. A constitution is employed in which to one of the left and right flange members 15, a driving force is transmitted from a driving portion (driving means) 39, and thus the flange member 15 is rotated by the driving portion 39. As a result, the fixing belt 10 is rotated by rotation of the flange member 15. In this way, in this embodiment, the fixing belt 10 can be directly rotationally driven by the flange member 15 rotated by the driving force from the driving portion 39, and therefore the driving constitution of the fixing belt 10 can be simplified.

As shown in FIG. 15, the fixing belt 10 is mounted around the heat-insulating stay holder 12 so that the markings 35 and the heat-insulating stay holder 12 are aligned with each other. That is, the fixing belt 10 is engaged with the heater 11 and the heat-insulating stay holder 12 by being moved in an arrow Q direction so that the markings 35 of the fixing belt 10 are moved along a heater surface of the heater 11 in the heat-insulating stay holder 12. As a result, the lubricant 100 can be supplied to the heater 11 and the heat-insulating stay holder 12 with reliability. For this reason, it becomes possible to uniformly apply the grease in a proper amount with reliability, so that the sliding property between the fixing belt 10 and the heat-insulating stay holder 12 can be stably maintained in a good state.

In the First to Fourth Embodiments and the Modified Embodiments 1 and 2 which are described above, as a heating source, the ceramic heater or the halogen heater is used, but the present invention is not limited thereto. It is also possible to employ a constitution using a high-frequency power source and an exciting coil in combination for electromagnetic induction heating.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 040403/2014 filed Mar. 3, 2014, which is hereby incorporated by reference.

What is claimed is:

1. An endless belt detachably mountable to an image heating apparatus, comprising:

a lubricant applied along a longitudinal direction of said endless belt onto a part of an inner surface of said endless belt with respect to a circumferential direction; and an indicating portion configured to indicate a mounting phase of said endless belt to an operator, wherein said indicating potion is provided on an outer surface of said endless belt so as to have a positional relationship with an applied region of the lubricant with respect to the circumferential direction.

2. An endless belt according to claim 1, wherein said indicating portion is provided at a free end portion of said endless belt with respect to a mounting direction of said endless belt.

3. An endless belt according to claim 1, wherein said indicating portion is formed on said endless belt by printing.

4. An endless belt according to claim 1, wherein said indicating portion is formed on said endless belt by marking.

5. An image heating apparatus comprising:

an endless belt configured to heat a toner image on a sheet in a nip;

a rotatable driving member configured to form the nip in cooperation with said endless belt and configured to drive said endless belt;

an urging member, provided and extended along a longitudinal direction of said endless belt, configured to urge said endless belt toward said rotatable driving member;

a limiting member configured to limit movement of said endless belt in the longitudinal direction by abutment against an end portion of said endless belt with respect to the longitudinal direction;

a first mark portion provided on said limiting member;

a lubricant applied along a longitudinal direction of said endless belt onto a part of an inner surface of said endless belt with respect to a circumferential direction; and a second mark portion configured to be positionally aligned with said first mark portion of said limiting member when said endless belt is fitted around said urging member, wherein said indicating potion is provided on an outer surface of said endless belt so as to have a positional relationship with an applied region of the lubricant with respect to the circumferential direction.

6. An image heating apparatus according to claim 5, wherein said indicating portion is provided at a free end portion of said endless belt with respect to a mounting direction of said endless belt.

7. An image heating apparatus according to claim 5, wherein said indicating portion is formed on said endless belt by printing.

8. An image heating apparatus according to claim 5, wherein said indicating portion is formed on said endless belt by marking.

9. An image heating apparatus according to claim 5, further comprising a heater configured to heat said endless belt.

10. A mounting method of mounting an endless belt in an image heating apparatus, comprising:

a step of preparing the endless belt which has an inner surface onto a part of which, with respect to a circumferential direction, a lubricant is applied along a longitudinal direction and which has an outer surface on which a first mark portion is provided so as to have a predetermined positional relationship with an applied region of the lubricant with respect to the circumferential direction;

a step of aligning a position of the first mark portion of the endless belt with a position of a second mark portion provided in the image heating apparatus; and a step of mounting the endless belt in a state in which the positions of the first mark portion and the second mark portion are aligned with each other.

11. A mounting method according to claim 10, wherein the image heating apparatus includes a rotatable driving member configured to form the nip in cooperation with said endless belt and configured to drive said endless belt, and includes an urging member, provided and extended along a longitudinal direction of said endless belt, configured to urge said endless belt toward said rotatable driving member, and wherein said mounting step, the endless belt is fitted around the urging member in the state in which the positions of the first mark portion and the second mark portion are aligned with each other.

* * * * *